US009613607B2

(12) United States Patent
Osuga et al.

(10) Patent No.: US 9,613,607 B2
(45) Date of Patent: Apr. 4, 2017

(54) KEYBOARD UNIT

(71) Applicant: YAMAHA CORPORATION, Hamamatsu-shi, Shizuoka (JP)

(72) Inventors: Ichiro Osuga, Hamamatsu (JP); Michiko Yoshimura, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 0 days.

(21) Appl. No.: 15/013,373

(22) Filed: Feb. 2, 2016

(65) Prior Publication Data

US 2016/0225358 A1 Aug. 4, 2016

(30) Foreign Application Priority Data

Feb. 4, 2015 (JP) ..... 2015-020122

(51) Int. Cl.
*G10H 1/34* (2006.01)

(52) U.S. Cl.
CPC ..... *G10H 1/344* (2013.01); *G10H 2220/271* (2013.01); *G10H 2220/285* (2013.01)

(58) Field of Classification Search
CPC .. G10H 1/18; G10H 1/32; G10H 1/34; G10H 1/344
USPC ..... 84/655, 653, 743–745
See application file for complete search history.

(56) References Cited

U.S. PATENT DOCUMENTS 3,536,819 A 10/1970 Kuriyagawa et al.
3,794,747 A 2/1974 Obayashi
4,031,797 A 6/1977 Schmoyer
4,416,178 A 11/1983 Ishida
5,079,985 A 1/1992 Yamaguchi et al.
5,237,123 A 8/1993 Miller
5,512,705 A 4/1996 Kobayashi
5,612,502 A 3/1997 Ura
5,679,914 A 10/1997 Niitsuma
5,691,489 A 11/1997 Fujiwara et al.
(Continued)

FOREIGN PATENT DOCUMENTS

JP S57104994 A 6/1982
JP H07104737 A 4/1995
(Continued)

OTHER PUBLICATIONS

Non-Final Office Action issued in U.S. Appl. No. 15/014,196, mailed Oct. 7, 2016.
(Continued)

*Primary Examiner* — David Warren
(74) *Attorney, Agent, or Firm* — Rossi, Kimms & McDowell LLP

(57) ABSTRACT

A keyboard unit includes: a key; a displacement member driven directly or indirectly with the key by a pressing operation to be moved; object detection sections including: detection sections, states of which become state change detection state when detecting changes instates of the key and the displacement member; and a generator, in a case that states of all the object detection sections become the state change detection state in the forward stroke of a key pressing operation, obtaining detection results of at least two sets of the detection sections, each set including two object detection sections, selecting at least one of the obtained detection results of the at least two sets of the detection sections, and generating sound generation indication information based on the selected at least one of the detection results.

13 Claims, 8 Drawing Sheets

(56) References Cited

U.S. PATENT DOCUMENTS

| | | | |
|---|---|---|---|
| 5,731,530 | A | 3/1998 | Fujiwara et al. |
| 5,739,450 | A | 4/1998 | Fujiwara et al. |
| 5,763,799 | A | 6/1998 | Kimble |
| 5,977,466 | A | 11/1999 | Muramatsu |
| 5,986,202 | A | 11/1999 | Seiler |
| 6,051,762 | A | 4/2000 | Fujiwara et al. |
| 6,191,351 | B1 | 2/2001 | Niitsuma |
| 6,297,437 | B1 | 10/2001 | Ura et al. |
| 6,365,820 | B1 | 4/2002 | Kondo et al. |
| 6,765,142 | B2 | 7/2004 | Sakurada et al. |
| 7,214,897 | B2 | 5/2007 | Chuang |
| 7,361,827 | B2 | 4/2008 | Sasaki |
| 7,408,108 | B2 | 8/2008 | Ludwig |
| 7,423,867 | B2 | 9/2008 | Yamamoto et al. |
| 7,432,430 | B2 | 10/2008 | Sasaki |
| 7,820,902 | B2 | 10/2010 | Furukawa et al. |
| 7,902,449 | B2 | 3/2011 | Furukawa et al. |
| 7,960,629 | B2 | 6/2011 | Sasaki |
| 2002/0046640 | A1 | 4/2002 | Kondo |
| 2005/0145104 | A1 | 7/2005 | Sasaki |
| 2006/0048624 | A1 | 3/2006 | Sasaki |
| 2006/0054010 | A1 | 3/2006 | Sasaki |
| 2006/0065103 | A1 | 3/2006 | Sasaki |
| 2007/0039452 | A1 | 2/2007 | Nishida |
| 2007/0169608 | A1 | 7/2007 | Fujiwara |
| 2007/0221036 | A1 | 9/2007 | Fujiwara |
| 2009/0084248 | A1 | 4/2009 | Furukawa et al. |
| 2009/0100979 | A1 | 4/2009 | Furukawa et al. |
| 2010/0229707 | A1 | 9/2010 | Sasaki |
| 2010/0288102 | A1 | 11/2010 | Fujiwara et al. |
| 2010/0294108 | A1 | 11/2010 | Shin |
| 2011/0132182 | A1 | 6/2011 | Kikumoto |
| 2013/0152769 | A1 | 6/2013 | Suzuki et al. |
| 2014/0069262 | A1 | 3/2014 | Cheever et al. |
| 2016/0225359 | A1 | 8/2016 | Osuga et al. |
| 2016/0225360 | A1 | 8/2016 | Osuga et al. |

FOREIGN PATENT DOCUMENTS

| | | | |
|---|---|---|---|
| JP | H08101687 | A | 4/1996 |
| JP | 09120286 | A | 5/1997 |
| JP | 09120287 | A | 5/1997 |
| JP | 09120288 | A | 5/1997 |
| JP | 09120289 | A | 5/1997 |
| JP | 2001312279 | A | 11/2001 |
| JP | 2007052357 | A | 3/2007 |
| JP | 2010160263 | A | 7/2010 |
| JP | 2013210451 | A | 10/2013 |

OTHER PUBLICATIONS

Non-Final Office Action issued in U.S. Appl. No. 15/014,349, mailed Aug. 24, 2016.

Office Action issued in Japanese Appln. No. 2015-020122 mailed Nov. 29, 2016. English machine translation provided.

| KEY |
|---|
| KEY 1 |
| KEY 2 |
| ⋮ |
| KEY 88 |

| SW | STATE | CHANGE TIME |
|---|---|---|
| SW2 | OFF | hh:mm:ss:xxxxx |
| SW3 | ON | hh:mm:ss:xxxxx |
| SW4 | ON | hh:mm:ss:xxxxx |
| SW5 | OFF | hh:mm:ss:xxxxx |
| SW6 | OFF | hh:mm:ss:xxxxx |
| SW7 | OFF | hh:mm:ss:xxxxx |
| SW8 | OFF | hh:mm:ss:xxxxx |

KEYBOARD UNIT

CROSS-REFERENCE TO RELATED APPLICATION(S)

This application is based upon and claims the benefit of priority from prior Japanese patent application No. 2015-020122, filed on Feb. 4, 2015, the entire contents of which are incorporated herein by reference.

BACKGROUND

The present invention relates to a keyboard unit having a displacement member that is driven directly or indirectly with a key by the pressing operation of the key and is displaced.

Keyboard musical instruments are available that have a displacement member, such as a hammer or the like, that is driven directly or indirectly with a key by the pressing operation of the key and is displaced (moved) in a forward stroke direction. In this kind of musical instrument, a keyboard musical instrument is also available in which the operation of a key or a displacement member is detected and musical sound is controlled on the basis of the result of the detection. For example, in the technology disclosed in JP-A-2010-160263, three or more contact sections that are turned ON sequentially according to key pressing operation are provided, and the key pressing velocity and sound generation timing are controlled when two contact sections corresponding to a designated performance style are turned ON sequentially.

Generally, in a musical instrument in which the operation of a displacement member, such as a hammer, operating in synchronization with a key is used for musical sound control, the control is carried out on the implicit premise that the displacement member operates almost accurately in synchronization with the key in all performance styles.

However, in reality, for example, the key and the hammer do not always operate accurately in synchronization with each other, and the relative relationship between the key and the hammer is complicated depending on various key pressing and releasing operation modes, such as the strength and depth of key pressing operation and the timing of key releasing operation. In this kind of case, if musical sound is controlled on the basis of only the detection result of the operation of the hammer, for example, by using the timing of the detection that the hammer has reached a specific position in the forward stroke direction as the sound generation timing, accurate musical sound control cannot always be carried out in some cases. The player of the musical instrument may feel uncomfortable in some cases, for example, because the timing of key pressing operation does not coincide with the timing of sound generation or the strength of pressing the key does not match the volume of the generated sound.

SUMMARY

The presently disclosed subject matter may provide a keyboard unit capable of monitoring the detection results at three or more positions and making use of the detection results for appropriate musical sound control.

The keyboard unit may comprise: a key; at least one displacement member which is configured to be driven directly or indirectly with the key by a pressing operation of the key to be moved in a forward stroke direction; a detector including, as object detection sections, at least three detection sections including: a detection section, a state of which becomes a state change detection state when detecting a change in a state of the key; and a detection section, a state of which becomes a state change detection state when detecting a change in a state of the displacement member; and a generator, in a case that states of all the object detection sections become the state change detection state in the forward stroke of a key pressing operation, which is configured to obtain detection results of at least two sets of the detection sections, each set including two object detection sections, which is configured to select at least one of the obtained detection results of the at least two sets of the detection sections, and which is configured to generate sound generation indication information based on the selected at least one of the detection results.

The generator may be configured to determine a timing at which the state of the last object detection section in the forward stroke of the key pressing operation becomes the state change detection state, as a sound generation timing.

The generator may be configured to determine a key pressing velocity of the key based on a time difference between timings at which the states of two object detection sections included in each set of the detection sections become the state change detection state.

In a case that the states of all the object detection sections become the state change detection state, the generator may be configured to determine the key pressing velocity based on a value obtained by proportionally dividing time differences between timings at which the states of the object detection sections included in each of the at least two sets of the detection sections become the state change detection state.

The keyboard unit may comprise: a key; at least one displacement member which is configured to be driven directly or indirectly with the key by a pressing operation of the key to be moved in a forward stroke direction; a detector including, as object detection sections, three or more detection sections including: a detection section, a state of which becomes a state change detection state when detecting a change in a state of the key; and a detection section, a state of which becomes a state change detection state when detecting a change in a state of the displacement member; a first determiner, in a case that states of the object detection sections other than one object detection section of all the object detection sections of the detector become the state change detection state in the forward stroke of a key pressing operation, which is configured to determine a predicted timing of sound generation based on detection results of at least one or more sets of the detection sections, each set being formed by combining two object detection sections of the other object detection sections; and a second determiner, in a case that the state of the last object detection section of the detector in the forward stroke of the key pressing operation becomes the state change detection state earlier than the predicted timing determined by the first determiner, which is configured to determine a timing at which the state of the last detection section becomes the state change detection state, as a sound generation timing, and, in a case that the predicted timing is earlier than the timing at which the state of the last object detection section of the detector becomes the state change detection state, which is configured to determine the predicted timing, as a sound generation timing.

In a case that the state of the last object detection section becomes the state change detection state in the forward stroke of the key pressing operation earlier than the predicted timing determined by the first determiner, the second determiner may be configured to determine a key pressing velocity based on time differences between timings at which the states of the object detection sections of at least one or more sets of the detection sections, each set being formed by combining two object detection sections of the other object detection sections, become the state change detection state.

In a case that the predicted timing determined by the first determiner is earlier than the timing at which the state of the last object detection section becomes the state change detection state in the forward stroke of the key pressing operation, the second determiner may be configured to determine a key pressing velocity based on time differences between timings at which the states of the object detection sections of at least one or more sets of the detection sections, each set being formed by combining two object detection sections of the detector including the last object detection section, become the state change detection state.

The object detection sections of the detector may include a detection section, a state of which becomes the state change detection state when a displacement end position of the displacement member in the forward stroke direction is restricted.

Musical sound may be generated based on the sound generation indication information generated by the generator.

The sound generation indication information generated by the generator may be output to an external device.

The sound generation indication information generated by the generator may be stored in a storage.

There may be also provided a keyboard musical instrument comprising the keyboard unit.

The keyboard unit may comprise: a key; at least one hammer which is configured to be driven directly or indirectly with the key by a pressing operation of the key to be moved in a forward stroke direction; object detection sections which are at least three detection sections including: a detection section, a state of which becomes a state change detection state when detecting a change in a state of the key; and a detection section, a state of which becomes a state change detection state when detecting a change in a state of the hammer; and a control circuit, in a case that states of all the object detection sections become the state change detection state in the forward stroke of a key pressing operation, which is obtain detection results of at least two sets of the detection sections, each set including two object detection sections, which is configured to select at least one of the obtained detection results of the at least two sets of the detection sections, and which is configured to generate sound generation indication information based on the selected at least one of the detection results.

DETAILED DESCRIPTION OF EXEMPLARY EMBODIMENTS

Embodiments according to the present invention will be described below referring to the accompanying drawings.

First Embodiment

Figure 1:
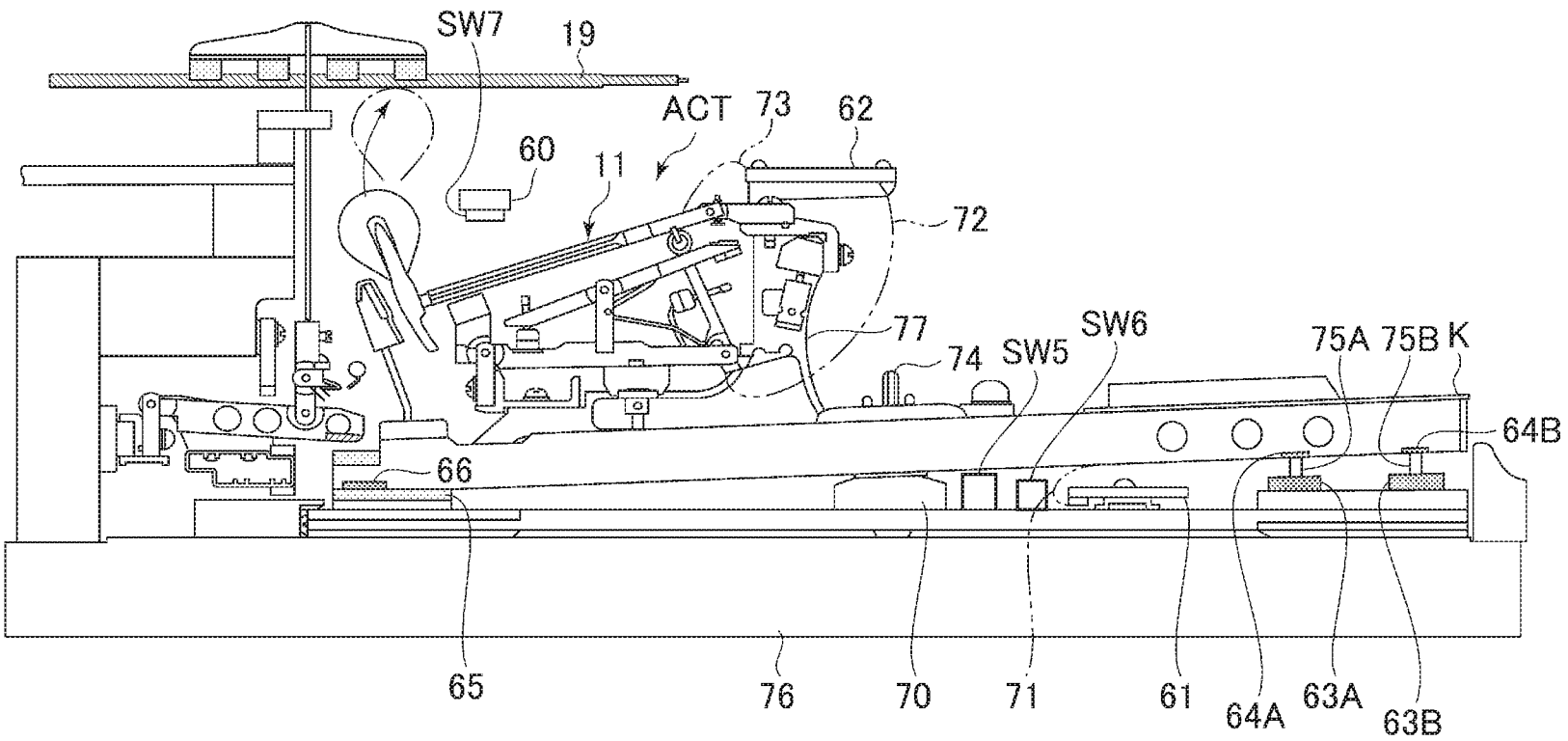
FIG. 1 is a vertical cross-sectional view showing a keyboard unit according to a first embodiment of the present invention.

FIG. 1 is a vertical cross-sectional view showing a keyboard unit according to a first embodiment of the present invention. FIG. 1 mainly shows the configurations of a key K and an action mechanism ACT for the key, for example.

This keyboard unit is configured as part of a grand piano type electronic keyboard musical instrument in which a plurality of keys K, white keys and black keys, are arranged in parallel. The action mechanism ACT for each key K is provided above the rear end section of the key K. Each key K is disposed so as to be rotatable clockwise and counterclockwise in FIG. 1 with a portion near a balance pin 74 at a key fulcrum section 70 being used as a fulcrum. The right side in FIG. 1 is the side of the player and the front side of the keyboard unit, and the left side is the rear side thereof. The front section of the key K is pressed and released.

This keyboard unit can generate sound using a hammer 11 that strikes a string 19 and also can generate sound electronically by detecting the movements and positions of elements in the action mechanism ACT and the like. A silencing stopper 60 is mounted such that its position is variable with respect to a base section 76 including a keyboard reed so that the position of the silencing stopper 60 can be switched by operating an operation device, not shown. In the case of a normal performance in which the string is struck, the silencing stopper 60 is placed at a position where the hammer 11 does not make contact therewith. When a performance is carried out in a silencing mode, the silencing stopper 60 is placed at a position where the hammer 11 makes contact therewith so that the hammer 11 does not make contact with the string 19.

Front bushing cloths 64A and 64B are provided at the front lower section of the key K. Front punching cloths 63A and 63B are disposed at positions corresponding to the positions of the front bushing cloths 64A and 64B. The front bushing cloths 64A and 64B are made contact with the front punching cloths 63A and 63B by key pressing operation, whereby the turning end position (end position) of the key K is restricted. The movement of the front section of each key K in the arrangement direction of the keys is restricted by front pins 75A and 75B during key pressing operation.

A conductive section 66 is provided at the rear lower section of the key K. A back rail cloth 65 is disposed on the base section 76 via a back rail under felt at the position corresponding to the conductive section 66. The rear lower face of the key K makes contact with the back rail cloth 65, whereby the conductive section 66 makes contact with the back rail cloth 65, and the initial position of the key K in the non-pressing state of the key, that is, the turning start position (rest position) of the key K, is restricted.

An electric circuit board 61 is disposed so as to be fastened to the base section 76. In addition, an electric circuit board 62 is disposed so as to be fastened to an action bracket 77. Although electric circuit boards other than these are also provided, they are not shown in the figure.

Figure 2:
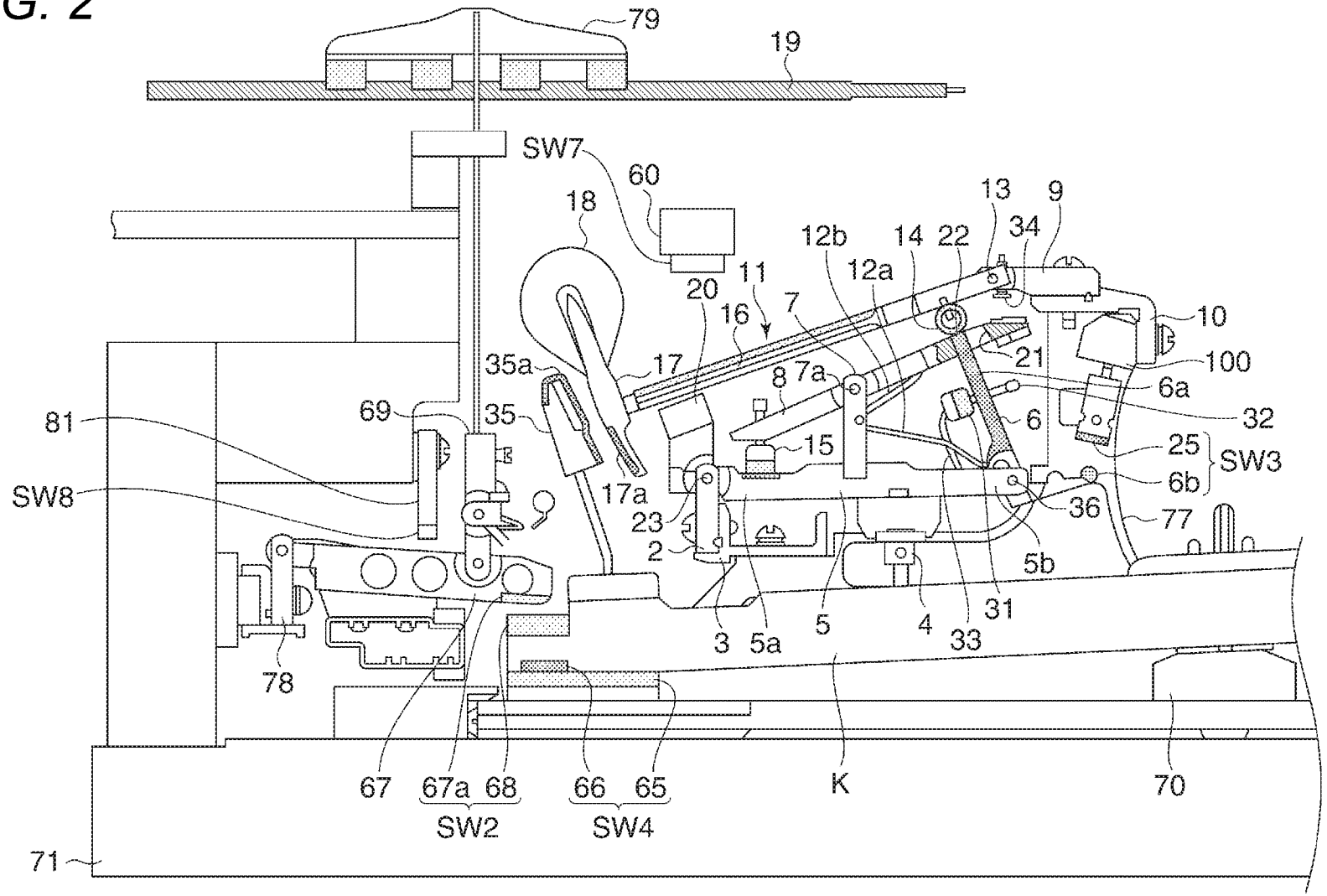
FIG. 2 is a side view showing an action mechanism and its peripheral elements.

FIG. 2 is a side view showing an action mechanism ACT and its peripheral elements.

A capstan screw 4 is implanted on the upper face of the rear end section of the key K. A back check 35 is provided at the rear end upper section of the key K. A damper lever 67 is pivotally supported by a damper lever flange 78 provided behind the key K. In addition, the damper lever 67 is pivotally supported by a damper block 69, and a damper 79 is fastened to the damper block 69.

The action mechanism ACT is mainly equipped with a wippen 5, a jack 6 and a repetition lever 8. The turning fulcrum 23 at the rear end section 5*a* of the wippen 5 is pivotally supported by a support flange 2 fastened to a support rail 3, and the front end 5*b* of the wippen 5 serving as a free end is made turnable around the turning fulcrum 23 in the up-down direction. A hammer shank stop felt 20 is disposed on the upper face of the wippen 5 on the side of the turning fulcrum 23. A jack stop 33 protrudes at the upper section of the front half section of the wippen 5.

A repetition lever flange 7 protrudes upward at the center of the wippen 5 in the front-rear direction. The repetition lever 8 is supported so as to be turnable clockwise and counterclockwise around the turning fulcrum 7*a* at the upper end section of the repetition lever flange 7. The jack 6 has a vertical section 6*a* extending nearly upward and a small jack 6*b* extending forward in a nearly horizontal direction, thereby being formed into a nearly L-shape in a side view. The jack 6 is disposed so as to be turnable clockwise and counterclockwise in FIG. 2 around the turning fulcrum 36 at the front end 5*b* of the wippen 5.

The jack stop 33 has a jack button screw 32 and a jack button 31 provided at the rear end section of the jack button screw 32. In the non-pressing state of the key (the releasing state of the key), the jack 6 makes contact with the jack button 31, whereby the initial position of the jack 6 is restricted and can be adjusted with the jack button screw 32.

A shank flange 9 is fastened to a shank rail 10. A regulating button 25 is provided on a regulating rail 100 mounted on the shank rail 10 so as to be adjustable in height with respect thereto. A repetition screw 34 is provided at the lower section of the shank flange 9. The hammer 11 is disposed above the repetition lever 8. The front end section of the hammer shank 16 of the hammer 11 is pivotally supported by the shank flange 9 so as to be turnable around a turning center 13 in the up-down direction. A hammer wood 17 is mounted at the rear end of the hammer shank 16 serving as a free end. A hammer felt 18 is mounted at the upper end of the hammer wood 17. A hammer roller 14 is provided near the front end section of the hammer shank 16.

In the non-pressing state of the key, the repetition lever 8 receives the hammer roller 14 from below at the upper face of the front end section thereof, thereby restricting the hammer 11 to its initial position. On the other hand, at the rear end section of the repetition lever 8, a repetition lever button 15 is disposed so as to be adjustable in height. This button 15 makes contact with the upper face of the rear end section 5*a* of the wippen 5, whereby the turning of the repetition lever 8 in the counterclockwise direction is restricted and the repetition lever 8 is restricted to its initial position.

A slot 21 is formed at the front end section of the repetition lever 8. The vertical section 6*a* of the jack 6 is inserted into the slot 21, and the top end face 22 of the vertical section 6*a* is almost flush with the upper face of the repetition lever 8.

In the above-mentioned configuration, in a normal key pressing forward stroke in which the key K being in its non-pressing state is pressed, the wippen 5 is pushed up by the rising of the capstan screw 4 and is turned around the turning fulcrum 23 counterclockwise, that is, in the forward stroke direction thereof. Since the wippen 5 is pushed up, the repetition lever 8 and the jack 6 are turned upward together with the wippen 5. With the turning of these elements, first, the repetition lever 8 and the vertical section 6*a* of the jack 6 push up the hammer 11 via the hammer roller 14 while allowing the hammer roller 14 to rotate and slide, thereby turning the hammer 11 upward.

On the other hand, with the turning of the key K in the forward stroke direction, a damper lever cushion 68 provided at the upper section of the rear end section of the key K pushes up the front end section of the damper lever 67. As a result, the damper 79 is raised via the damper block 69 and then the damper 79 (strictly speaking, damper felts provided at the lower section of the damper 79) is separated from the string 19.

Next, when the repetition lever 8 makes contact with and is engaged with the repetition screw 34, the displacement (the upper limit position) of the repetition lever 8 in the counterclockwise direction is restricted. Hence, the top end face 22 of the vertical section 6*a* of the jack 6 protrudes while passing through the slot 21 of the repetition lever 8, whereby the hammer roller 14 is driven by the top end face 22 and the hammer 11 is pushed up.

When the wippen 5 is turned further in the forward stroke direction, the small jack 6*b* of the jack 6 makes contact with the lower face of the regulating button 25 (strictly speaking, a regulating button punching) in the middle of the turning, and the rising of the small jack is stopped. However, since the wippen 5 itself is turned further, the jack 6 is turned clockwise around the turning fulcrum 36. Hence, the top end face 22 of the vertical section 6*a* of the jack 6 is moved away from the hammer roller 14 from the lower side to the front side and escapes therefrom. As a result, the hammer 11 is disengaged from the jack 6 and set to a free turning state, thereby striking the string 19. After striking the string, the hammer 11 is turned by its own weight and by the repulsion force of the string 19, thereby returning to its original position. However, in the silencing mode, the hammer shank 16 of the hammer 11 is restricted from turning by the silencing stopper 60, whereby the hammer 11 does not make contact with the string 19.

When the key pressing state is maintained after the end of the key pressing operation, the hammer wood 17 of the hammer 11 bounced back by the string 19 is received by the back check 35 (strictly speaking, a back check cloth 35*a*) and becomes stationary. When the key K is released and when the back check 35 is disengaged from the hammer 11, the repetition lever 8 is turned counterclockwise by the energizing force of a repetition energizing section 12*b*, and the hammer roller 14 is supported by the repetition lever 8.

Furthermore, after the string striking operation, as the wippen 5 is turned and returned to its original position, the jack 6 is released from the regulating button 25 and turned counterclockwise by the energizing force of a jack energizing section 12*a* and returned to its original position. Since the top end face 22 of the vertical section 6*a* of the jack 6 is returned quickly to the lower side position of the hammer roller 14, the next string striking operation can be carried out by pressing the key again, even if the key K is not returned completely to its non-pressing position. In other words, key pressing can be made quickly and repeatedly.

In the keyboard unit according to this embodiment, an element, the engagement state of which with an object to be engaged is changeable in the stroke of key pressing/releasing operation, is referred to as "a member." The member includes not only a single component but also component members configured as an integrated unit or members configured to be movable as an integrated unit. For example, the members correspond to the key K (key body) and the hammer 11 (hammer body), and also correspond to the elements intervened in the system ranging from the key K to the hammer 11 or elements for restricting the turning start positions and the turning stop positions of the key and the hammer 11. More specifically, in addition to the above-mentioned items, the elements designated by reference numerals 5, 6, 7, 8, 9, 11, 15, 19, 20, 25, 31, 34, 35, 60, 63, 65, 79, etc. can correspond to the members. The elements 64, 66 and 68 may be grasped as portions of the key K. The elements 14, 16, 17 and 18 may be grasped as portions of the hammer 11. The movable members other than the key K can correspond to displacement members. However, the members are not limited to these items taken as examples.

In the keyboard unit according to this embodiment, a plurality of detection sections SW (detection sections SW2 to SW8) including detection sections SW5, SW6 and SW7 are provided for the key K. The detection sections SW directly detect the operations of the key K and the displacement members or the engagement states of the members to be engageable with each other thereby to indirectly detect the operations of the members.

With this embodiment, attention is paid to "displacement members" that are driven directly or indirectly with the key K by the pressing operation of the key so as to be displaced (moved) in the forward stroke direction and that are allowed to be moved in the returning direction by the releasing operation of the key K. Furthermore, musical sound information including the key pressing velocity of the key is generated on the basis of the detection of the operations of the key and the displacement members, and sound generation timing is determined. As a displacement member, the hammer 11 is first taken as an example. The pressing operation of the key K is detected by the detection sections SW5 and SW6, and the turning operation of the hammer 11 is detected by the detection section SW7. The detection results of these three detection sections SW5 to SW7 are monitored, and, for example, the sound generation timing is determined on the basis of the results of the monitoring.

The detection sections SW2 to SW8 are merely required to be configured so as to be able to detect the operations of the key K and the displacement member and can have configurations suited for the positions where they are disposed. For example, the detection section SW7 is disposed on the lower face of the silencing stopper 60. Hence, in the silencing mode, the hammer 11 makes contact with the detection section SW7 and indirectly makes contact with the silencing stopper 60 via the detection section SW7. The detection sections SW5 and SW6 (FIG. 1) are disposed ahead of the key fulcrum section 70 and are turned ON when they are pressed down by the key K that is operated so as to be pressed down. Since the detection section SW5 protrudes higher than the detection section SW6, the detection section SW5 turns ON earlier than the detection section SW6 in the forward stroke of the key pressing operation.

The detection sections SW5 to SW8 are general dome type make-switches. When each of the switches is pressed, its movable contact makes contact with its fixed contact, and the switch turns ON electrically. For example, in the silencing mode, the detection section SW7 turns ON when pressed by the hammer 11 and turns OFF when the pressing is released. Hence, the detection section SW7 turns ON almost simultaneously when the hammer 11 makes contact with the detection section SW7 and the displacement end position of the hammer 11 in the forward stroke direction is restricted by the silencing stopper 60 via the detection section SW7. The detection section SW8 (FIG. 2) has a configuration similar to that of the detection section SW7. The detection section SW8 turns ON when pressed by the damper lever 67 that turns in the forward stroke direction.

As the detection sections SW2 to SW4, a switch having an ordinary switch configuration in which the state of the switch becomes ON by making contact with an object or by detecting the change in pressure may be adopted. However, in this embodiment, a configuration in which the engagement state of members is detected depending on the state of the electrical conduction between the members is taken as an example. More specifically, each of the engaged sections of the members being engaged with each other is configured so as to have conductivity, and a CPU 45 (FIG. 3A) detects the engagement state of the two by utilizing the fact that conduction occurs when the two make contact with each other and that non-conduction occurs when the two are separated.

In order that the above-mentioned conduction configuration is attained easily, for example, conductive materials are provided in the regions of the engaged sections being engaged with each other. As a conductive material, graphite, conductive rubber, conductive nonwoven fabric, copper plate, conductive coating (conductive grease) or the like is provided on at least the surfaces or the engagement faces in the regions of the engagement. In the case that cloth or the like is used, the entire cloth may be formed of a conductive material. Alternatively, the whole or at least the respective engaged sections of the movable members and the corresponding members may be made of a conductor or a conductive material. For example, the whole or the engaged sections of the members are formed of resin. The configuration for giving conductivity may be different between the movable members and the corresponding members.

Some typical examples are taken as described below. In the case of the detection section SW2, both the key K (the damper lever cushion 68 thereof) and the damper lever 67 (the contact section thereof) are made of conductors. In the case of the detection section SW3, both the regulating button 25 and the jack 6 are made of conductors. In the case of the detection section SW4, both the back rail cloth 65 and the key K (the conductive section 66 thereof) are made of conductors. A configuration similar to that described above is applicable to both the members other than these members. Both the jack 6 and the hammer roller 14 may be made of conductors.

The conductive sections having conductivity are electrically connected to the electric circuit boards. In FIG. 2, the electric circuit boards are not shown. As shown in FIG. 1, for example, the conductive section of the jack 6 is connected to an electric circuit board 62 with a wire 72, such as a flexible lead, and the hammer roller 14 is also connected to the electric circuit board 62 with a wire 73. Moreover, to the electric circuit board 61, the front bushing cloths 64A and 64B are connected with a wire 71, and the front punching cloths 63A and 63B are also connected with wires, not shown. The conductive sections of the other engaged sections are also connected as necessary to the electric circuit boards 61 and 62 or electric circuit boards, not shown, with wires.

Each detection section SW electrically turns ON when it becomes conductive and electrically turns OFF when it becomes non-conductive. In this embodiment, however, in the detection section SW relating to the key K and a displacement member, the case in which the detection section SW detects that the state of the displacement member has changed in the forward stroke of the key, for example, the case in which the detection section SW detects that the displacement member has been located at a position away from a certain position in the forward stroke direction is referred to as "an operation detection state (state change detection state)." For example, in the detection sections SW7 and SW8, the state of turning ON electrically corresponds to the operation detection state.

On the other hand, as in the detection section SW4, the back rail cloth 65 is separated from the conductive section 66 of the key K when the key is pressed even just a little bit, and the detection section SW4 turns OFF. In this type of detection section that turns ON electrically in the non-pressing state of the key, the key pressing operation is detected when the detection section electrically turns OFF. Hence, the state of being OFF electrically is referred to as "an operation detection state." The operation detection state is hereafter simply referred to as "detection ON" in some cases.

The detection sections SW2 to SW8 are not limited particularly in configuration, and, for example, a magnet type or an optical type may be adopted. All the detection sections SW2 to SW8 are not always required. The present invention is applicable in the case that at least three detection sections SW including the detection section for detecting the operation of the key K and the detection section for detecting the operation of the displacement member are provided.

Figure 3A:
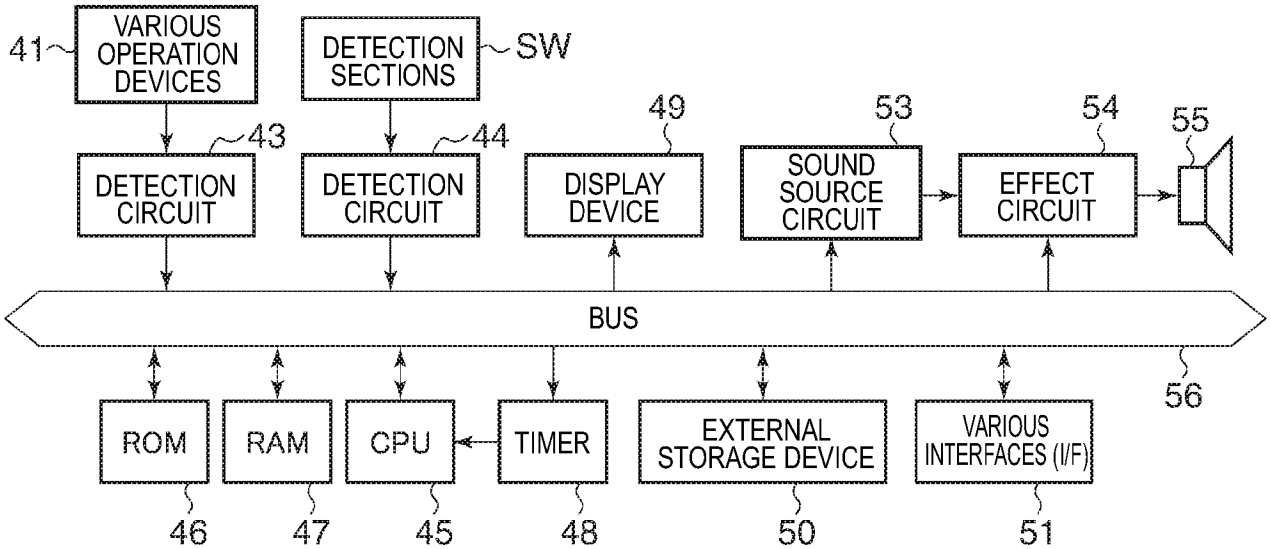
FIG. 3A is a block diagram showing the whole configuration of the keyboard unit.

FIG. 3A is a block diagram showing the whole configuration of the keyboard unit. The keyboard unit has a configuration in which a detection circuit 43, a detection circuit 44, a ROM 46, a RAM 47, a timer 48, a display device 49, an external storage device 50, various interfaces (I/F) 51, a sound source circuit 53, and an effect circuit 54 are respectively connected to the CPU 45 via a bus 56.

Furthermore, the detection sections SW are connected to the detection circuit 44. Various operation devices 41 include playing operation devices, such as the key K. The timer 48 is connected to the CPU 45, and a sound system 55 is connected to the sound source circuit 53 via the effect circuit 54.

The detection circuit 43 detects the operation states of the various operation devices 41. The detection circuit 44 detects the conduction states of the detection sections SW and supplies the results of the detection to the CPU 45. The CPU 45 controls the whole unit. The ROM 46 stores control programs to be executed by the CPU 45, various table data, etc. The RAM 47 temporarily stores various input information, such as performance data and text data, various flags, buffer data, operation results, etc. The timer 48 counts an interruption time in timer interruption processing and various times. The various interfaces (I/F) 51 include a MIDI interface and a communication interface. The sound source circuit 53 converts performance data having been input from the various operation devices 41, preset performance data, etc. into musical sound signals. The effect circuit 54 gives various effects to musical sound signals to be input from the sound source circuit 53, and the sound system 55 including a DAC (digital-to-analog converter), an amplifier, speakers, etc. converts musical sound signals and the like to be input from the effect circuit 54 into sound.

Figure 3B:
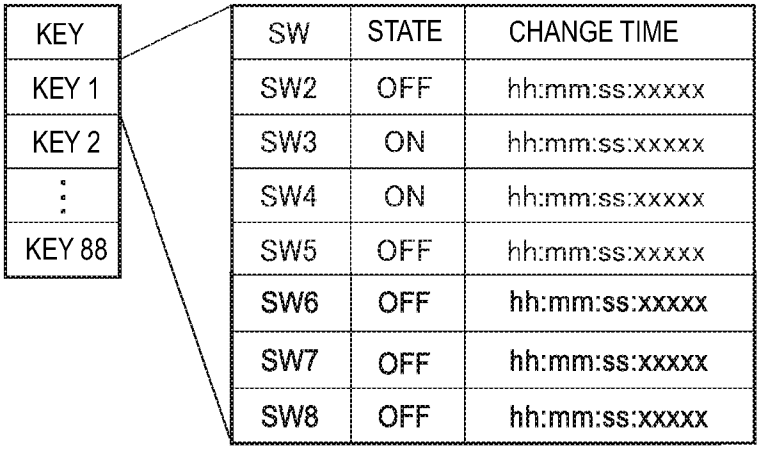
FIG. 3B is a conceptual drawing indicating the information of the detection results in the detection sections, the information being stored in a register.

FIG. 3B is a conceptual drawing indicating the information of the detection results in the detection sections SW, the information being stored in a register. The information of the detection results in the detection sections SW is information indicating ON/OFF conduction states and change times when ON/OFF switching has occurred, and the information for all the detection sections SW is stored in the register of the RAM 47 for each key K. However, the information on the detection sections SW in which the detection information is not used is not necessary to be stored.

Figure 4A:
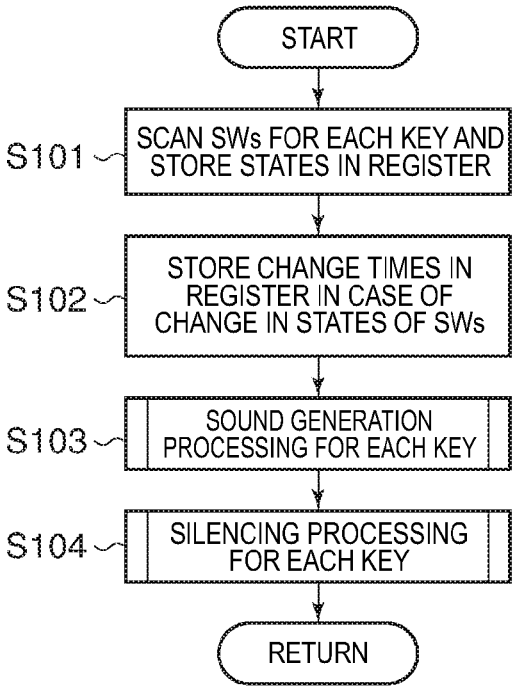
FIG. 4A is a flowchart showing main processing.

FIG. 4A is a flowchart showing main processing. This processing is executed at predetermined intervals (for example, every 100 μsec). First, the CPU 45 scans the detection sections SW for each key K and stores the results (ON or OFF) of the scanning in the register for each key K (at step S101). Next, in the case that the states of the detection sections SW have changed, that is, the ON/OFF states thereof have changed, the CPU 45 also stores the change times of the states (at step S102). Hence, the information (FIG. 3B) on the results of the detection is stored for each key K and renewed as necessary. The processing for scanning the detection sections SW and the processing for storing the states in the register may also be carried out sequentially and automatically by hardware.

Next, the CPU 45 carries out the sound generation processing for each key K (at step S103), and then carries out the silencing processing (FIG. 4B) for each key K (at step S104), thereby ending the processing shown in FIG. 4A.

Musical sound control can be carried out on the basis of the results of the detection of the plurality of detection sections SW. Furthermore, the results of the detection of the detection sections SW can be used for not only musical sound control, but also the recording of performance as performance data for musical sound control. The detection sections SW to be used for musical sound control and for the recording of performance data are not limited particularly. In other words, any detection sections SW may be adopted as detection sections SW for generating the musical sound information that is used to determine a sound generation trigger and the key pressing velocity. Moreover, any detection sections SW may be adopted as detection sections SW for the silencing of generated musical sound.

In this embodiment, an example in which both sound generation processing and silencing processing are carried out using the three detection sections SW, that is, the detection sections SW5 and SW6 for detecting the operation of the key K and the detection section SW7 for detecting the operation of the hammer 11 serving as a displacement member, will be described below as a representative. These three detection sections SW for generating the musical sound information are used as object detection sections serving as detectors and are referred to as "object SWs." Furthermore, the detection section SW5 is taken as an example of the detection section SW for silencing.

Figure 4B:
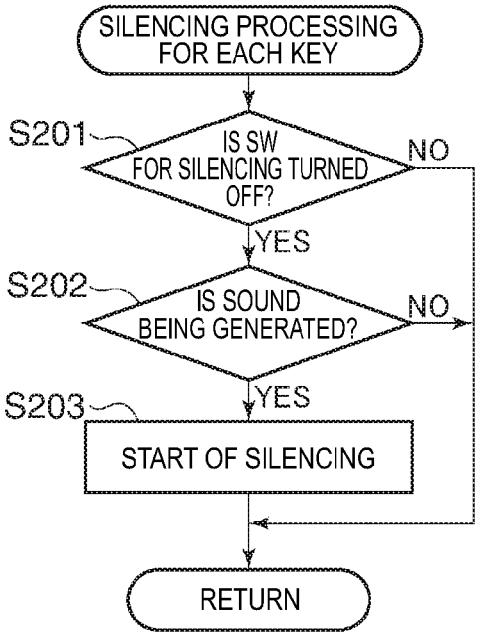
FIG. 4B is a flowchart showing silencing processing for each key.
Figure 5:
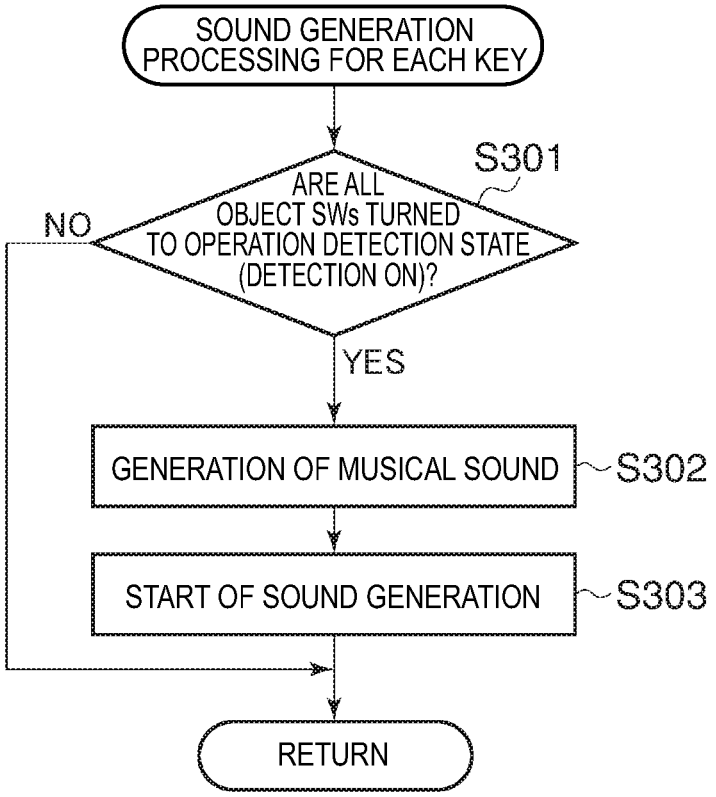
FIG. 5 is a flowchart showing sound generation processing for each key.

FIG. 4B is a flowchart showing silencing processing for each key K to be executed at step S104 in FIG. 4A. FIG. 5 is a flowchart showing sound generation processing for each key K to be executed at step S103 in FIG. 4A.

First, at step S301 in FIG. 5, the CPU 45 judges whether the states of all of the object SWs, that is, the states of all of the three detection sections SW5 to SW7, become the operation detection state (detection ON). This judgment is made referring to the information (FIG. 3B) of the results of the detection and also made similarly at the following steps.

In the case that the state of any one of the object SWs is not detection ON (the state is the operation non-detection state (OFF)) as the result of the judgment, the current timing is not the timing at which sound should be generated, whereby the processing shown in FIG. 5 ends without sound generation.

In normal key pressing operation, however, the states of the detection sections become detection ON in the order of SW5, SW6 and SW7. Hence, when the state of the detection section SW7 becomes detection ON, the states of all of the object SWs become detection ON. In other words, the state of the detection section SW7 becomes detection ON at the end of the forward stroke of the key pressing operation. However, in the case that the key K is pressed strongly only in the early stage of the key pressing operation and then pressed slowly, the states of the detection sections may become detection ON in the order of SW5, SW7 and SW6 or in the order of SW7, SW5 and SW6. In these cases, the states of all of the object SWs become detection ON when the state of the detection section SW6 becomes detection ON.

In the case that the states of all of the object SWs become the operation detection state (detection ON), it can be judged that sound generation by the key pressing operation is intended, the CPU 45 generates the musical sound information (at step S302). There are several modes for the generation of the musical sound information, and five modes will herein be described as examples referring to FIG. 6.

Figure 6:
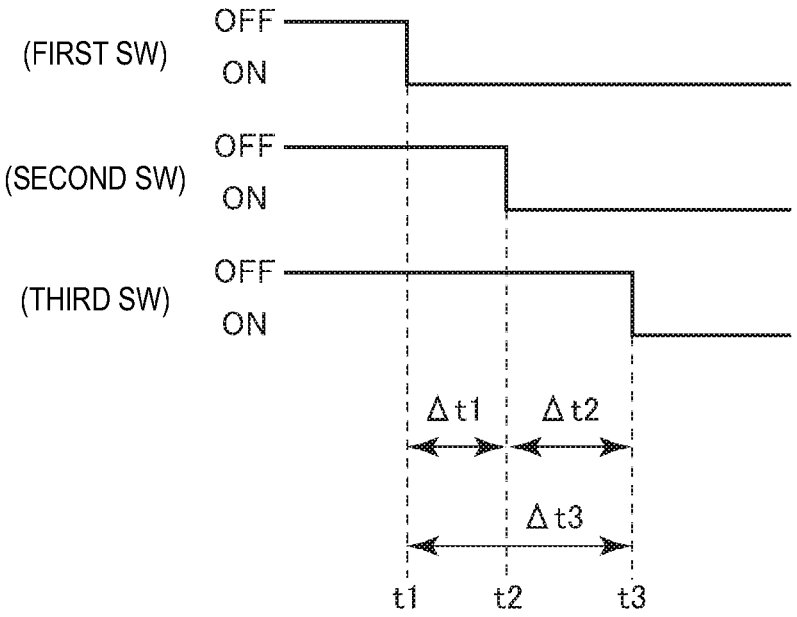
FIG. 6 is a time chart showing the operation detection states of object detection sections.

FIG. 6 is a time chart showing the operation detection states of the detection sections SW5 to SW7. The detection sections SW5 to SW7 are referred to as a first SW, a second SW and a third SW in the order in which the states of the detection sections become detection ON in the forward stroke of the key pressing operation. It is assumed that the time when the state of the first SW becomes detection ON is t1, that the time when the state of the second SW becomes detection ON is t2, and that that the time when the state of the third SW becomes detection ON is t3. It is also assumed that the time difference between time t1 and time t2 is Δt1, that the time difference between time t2 and time t3 is Δt2, and that the time difference between time t3 and time t1 is Δt3. The CPU 45 determines the key pressing velocity on the basis of at least any one of the time differences Δt1, Δt2 and Δt3 and generates the musical sound information.

First, in a first mode of the generation of the musical sound information, the shortest time difference of the time differences Δt1, Δt2 and Δt3 is selected, and a coefficient is multiplied to the reciprocal of the selected time difference Δt to obtain the key pressing velocity. Since the player cannot apply acceleration to the key K in the returning direction thereof, it is assumed that selecting the detection section SW having the highest displacement speed from among the detection sections SW is highly likely to match the intention of the player. In a second mode of the generation of the musical sound information, the median value of the time differences Δt1, Δt2 and Δt3 is selected, and a coefficient is multiplied to the reciprocal of the selected time difference Δt to obtain the key pressing velocity.

Furthermore, in a third mode of the generation of the musical sound information, in addition to the determination of the key pressing velocity in the first or second mode, tone is also determined on the basis of the median value of the time differences Δt1, Δt2 and Δt3. In a fourth mode of the generation of the musical sound information, in addition to the determination of the key pressing velocity in the first or second mode, the tone is also determined on the basis of the maximum value of the time differences Δt1, Δt2 and Δt3.

Moreover, in a fifth mode of the generation of the musical sound information, the key pressing velocity and the tone are determined on the basis of the value obtained by proportionally dividing at least two of the time differences Δt1, Δt2 and Δt3. For example, coefficients a, b and c are set beforehand depending on the characteristics of the mechanism of the keyboard unit. What's more, in the case that all the three time differences Δt1, Δt2 and Δt3 are used, the reciprocal of "a×Δt1+b×Δt2+c×Δt3" is determined as the key pressing velocity. Besides, in the case that two of the time differences Δt1, Δt2 and Δt3 are used, for example, the reciprocal of any one of "a×Δt1+b×Δt2", "a×Δt1+c×Δt3" and "b×Δt2+c×Δt3" is determined as the key pressing velocity. A calculation expression similar to that described above can also be applied to the determination of the tone. Separately set coefficients may also be used for the determination of the tone. Still further, the coefficients a, b and c are not required to be fixed values but they may be calculated dynamically on the basis of the time difference Δt1 that is obtained first.

In the above-mentioned examples of the modes of the generation of the musical sound information, after the three time differences Δt1, Δt2 and Δt3 are obtained, the key pressing velocity is determined and the musical sound information is generated. However, it is possible that after two time differences, for example, Δt1 and Δt2, are obtained, one or two of them are selected, and the musical sound information is generated.

After the musical sound information is generated, the CPU 45 then starts sound generation on the basis of the generated musical sound information (at step S303). In other words, the CPU 45 controls the sound source circuit 53, the effect circuit 54, etc. so that the musical sound having the sound pitch of the key K to be processed in this processing is generated at the velocity and the tone currently determined for the key K. Then, the processing shown in FIG. 5 ends.

As described above, in this embodiment, the musical sound information is generated on the basis of the detection results of at least one or more sets of detection sections, each set being formed by combining two detection sections SW. Furthermore, the timing at which the state of the last detection section SW of the object SWs in the forward stroke of the key pressing operation becomes the operation detection state (detection ON) is the sound generation timing at which sound generation is started.

The musical sound information including the key pressing velocity and the tone, and the sound generation timing are herein collectively referred to as "sound generation indication information." The CPU 45 generates the sound generation indication information as clarified as described above. At the above-mentioned step S303, the CPU 45 controls the sound source circuit 53, the effect circuit 54, etc. on the basis of the generated sound generation indication information, thereby making the keyboard unit itself generate musical sound. However, the processing relating to the sound generation indication information is not limited to the above-mentioned processing. For example, the CPU 45 may output the generated sound generation indication information to an external device via the various interfaces (I/F) 51 and may allow the external device to generate musical sound on the basis of the sound generation indication information. Alternatively, the sound generation indication information may be stored in the external storage device 50 or the like.

In the silencing processing for each key K shown in FIG. 4B, at step S201, the CPU 45 judges whether the state of the detection section SW (the detection section SW5) for silencing is OFF. In the case that the state of the detection section SW5 is ON as the result of the judgment, the CPU 45 ends the processing shown in FIG. 4B without starting silencing. On the other hand, in the case that the state of the detection section SW5 is OFF, the CPU 45 advances the processing to step S202 and judges whether the sound pitch corresponding to the key K to be processed at this time is being generated. In the case that the sound pitch is not being generated as the result of the judgment, the CPU 45 ends the processing shown in FIG. 4B. On the other hand, in the case that the sound pitch is being generated, the CPU 45 starts silencing the musical sound being generated (at step S203).

However, a detection section SW other than the object SWs may be adopted although one of the object SWs is adopted as the detection section SW for silencing. For example, in the case that the detection section SW2 is adopted as the detection section SW for silencing, the separation of the damper lever cushion 68 from the damper lever 67 (the contact section 67*a* thereof) becomes the silencing timing. In this case, the silencing timing almost coincides with the timing of the separation of the damper 79 from the string 19, whereby more natural silencing is carried out.

With this embodiment, in the case that the states of all of the object SWs become the operation detection state in the forward stroke of the key pressing operation, the musical sound information is generated on the basis of the detection results of at least one or more sets of the detection sections. Hence, while the results of the detection at three or more positions in the key K and the hammer 11 are monitored, musical sound is generated and can be made useful for appropriate musical sound control.

Furthermore, the timing at which the state of the last detection section SW of the object SWs in the forward stroke of the key pressing operation becomes the operation detection state (detection ON) is determined as the sound generation timing, whereby the sound generation timing can be determined appropriately so as to match the intention of the player. Moreover, the key pressing velocity is determined on the basis of the time difference (for example, Δt1) between the timings at which the states of the object detection sections in at least one or more sets of detection sections become the operation detection state. In particular, two or more sets of detection sections are selected and the key pressing velocity is determined on the basis of the value obtained by proportionally dividing the time differences of the timings at which the states of the detection sections of each of the selected sets of detection sections become the operation detection state, whereby the key pressing velocity can be determined appropriately so as to match the intention of the player.

Second Embodiment

In the first embodiment, the timing at which the state of the last detection section SW of the object SWs in the forward stroke of the key pressing operation becomes the operation detection state (detection ON) is determined as the sound generation trigger. In other words, in the first embodiment, unless the state of the last detection section SW becomes detection ON, sound generation is not carried out. On the other hand, in the second embodiment of the present invention, the predicted timing of sound generation or the timing at which the state of the last detection section SW becomes the operation detection state, whichever earlier, is used as the sound generation trigger. In other words, in the second embodiment, even if the state of the last detection section SW does not become detection ON, sound generation is carried out after a predetermined time passes. For example, in the case that the key K is pressed slowly, sound generation is carried out in the second embodiment although sound generation is not carried out in some cases in the first embodiment.

The second embodiment will be described below referring to FIG. 7 instead of FIG. 5.

Figure 7:
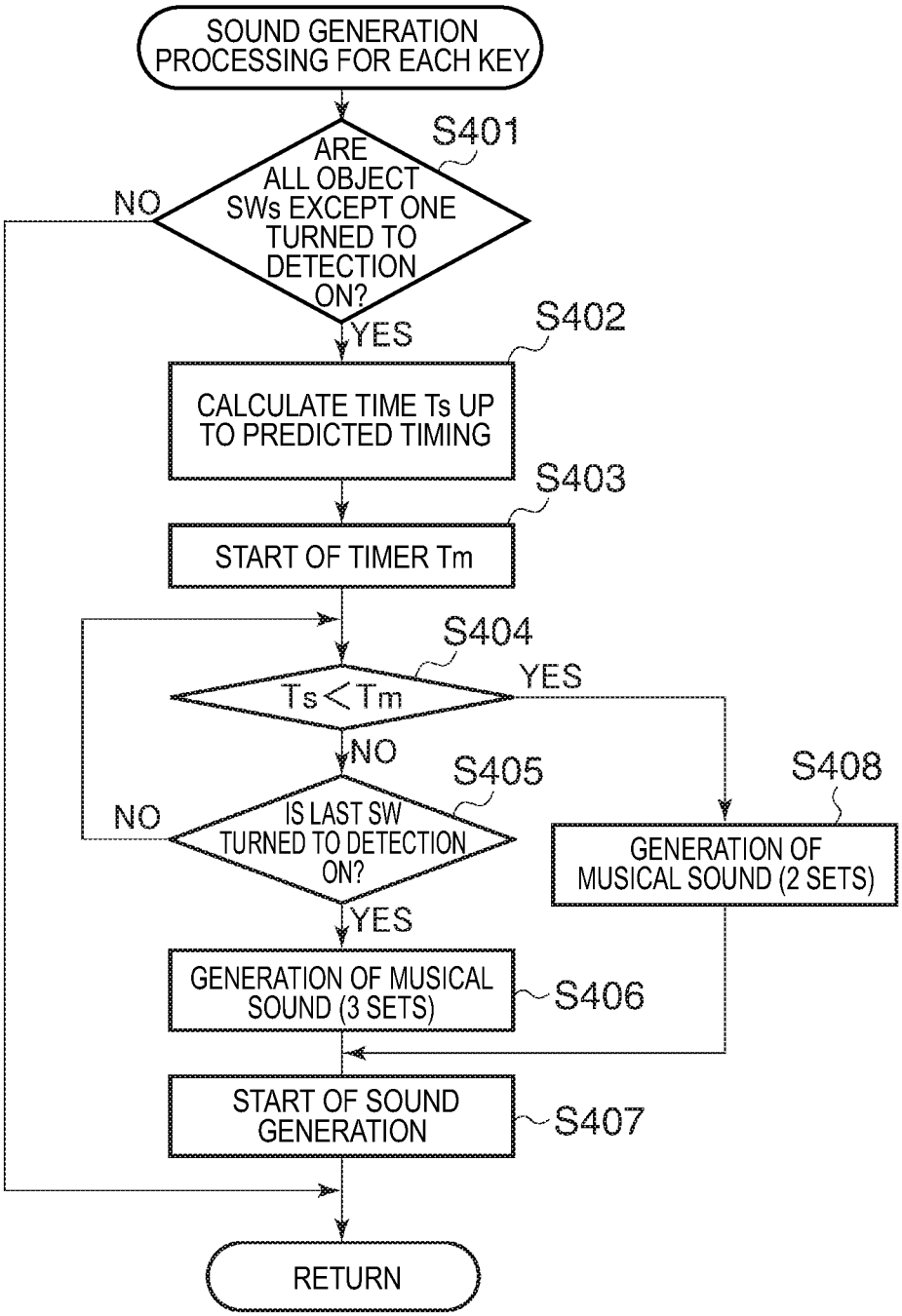
FIG. 7 is a flowchart showing sound generation processing for each key according to a second embodiment.

FIG. 7 is a flowchart showing sound generation processing for each key K to be executed at step S103 in FIG. 4A.

First, the CPU 45 scans the object SWs one by one and judges whether the states of all of the object SWs except one have become detection ON (at step S401). At this step, a judgment is made as to whether the states of two detection sections SW have become detection ON. In the case that the number of the detection sections SW being in the state of detection ON is one or less as the result of the judgment, the processing shown in FIG. 7 ends. On the other hand, in the case that not only the state of the first detection section SW but also the state of the second detection section SW becomes detection ON, the CPU 45 calculates time Ts up to the predicted timing of sound generation on the basis of the time difference Δt1 shown in FIG. 6 (at step S402) (a first determiner). For example, the value obtained by multiplying a coefficient to the time difference Δt1 is used as the time Ts.

Next, the CPU 45 sets an initial value in a timer Tm and starts time measurement (at step S403) and then judges whether the value of the timer Tm is more than time Ts (Ts<Tm) (at step S404). In the case that the value of the timer Tm is not more than time Ts (Ts≥Tm) as the result of the judgment, the CPU 45 judges whether the state of the last detection section SW (the third detection section SW in this case) of the object SWs in the forward stroke of the key pressing operation has become detection ON (at step S405). The CPU 45 then repeats steps S404 and S405 until the state of the last detection section SW becomes detection ON. In the case that the state of the last detection section SW becomes detection ON before the value of the timer Tm becomes more than time Ts, the CPU 45 generates the musical sound information at step S406. On the other hand, in the case that the value of the timer Tm becomes more than time Ts (Ts<Tm) although the state of the last detection section SW does not become detection ON, the CPU 45 generates the musical sound information at step S408.

At step S406, in the mode taken as an example, the CPU 45 determines the key pressing velocity on the basis of at least any one of the time differences Δt1, Δt2 and Δt3 and generates the musical sound information as in the case of step S302 in FIG. 5. At the time, the CPU 45 also determines the tone depending on the mode. The CPU 45 then starts sound generation on the basis of the generated musical sound information (at step S407) as in the case of step S303 in FIG. 5. Hence, the timing at which the state of the last detection section SW of the object SWs becomes the operation detection state (detection ON) becomes the start timing of sound generation (a second determiner). The determination of the start timing of sound generation is similar to that in the first embodiment.

On the other hand, since the detection result of the third detection section SW is not yet obtained at step S408, the CPU 45 generates the musical sound information on the basis of the detection results of the detection sections SW having already been obtained. For example, the value obtained by multiplying a coefficient to the reciprocal of the time difference Δt1 is determined as the key pressing velocity. The CPU 45 then starts sound generation on the basis of the generated musical sound information (at step S407).

Hence, in this case, the predicted timing becomes the start timing of sound generation before the state of the last detection section SW becomes the operation detection state (detection ON) (the second determiner). After steps S406 and S408, the processing shown in FIG. 7 ends.

With this embodiment, in the case that the state of the last detection section SW becomes the operation detection state in the forward stroke of the key pressing operation at the timing earlier than the predicted timing determined on the basis of the time difference Δt1 (Ts≥Tm), the timing at which the state of the last detection section SW becomes the operation detection state is determined as the timing of sound generation. On the other hand, in the case that the predicted timing is earlier than the timing at which the state of the last detection section SW becomes the operation detection state (Ts<Tm), the predicted timing is determined as the timing of sound generation. Hence, while the results of the detection at three or more positions in the key K and the hammer 11 are monitored, the timing of sound generation is determined and can be used for appropriate musical sound control.

In particular, even if the state of the last detection section SW does not become detection ON, sound generation is carried out at the timing when the value of the timer Tm becomes more than time Ts. Hence, even in the case that the key is pressed very slowly, sound generation can be carried out.

Furthermore, in the case that the state of the last detection section SW becomes the operation detection state at the timing earlier than the predicted timing, the key pressing velocity is determined on the basis of at least any one of the time differences Δt1 to Δt3 and the musical sound information is generated. On the other hand, in the case that the predicted timing is earlier than the timing at which the state of the last detection section SW becomes the operation detection state, the key pressing velocity is determined on the basis of the timing Δt1, whereby the key pressing velocity can be determined appropriately so as to match the intention of the player.

In the first and second embodiments, even if the detection section SW8 is used instead of the detection section SW7 serving as an object SW, sufficiently appropriate timing for sound generation can be determined. In this case, the damper lever 67 serves as the displacement member.

Furthermore, in first and second embodiments, although the number of the object SWs is three, three or more detection sections SW including the detection sections SW for detecting the operation of the key K and the detection sections SW for detecting the operation of the displacement member can be used as object SWs. For example, the four detection sections SW5 to SW8 may be used as object SWs. Another example in which four object SWs are used will be described referring to FIGS. 8A and 8B.

Figure 8A:
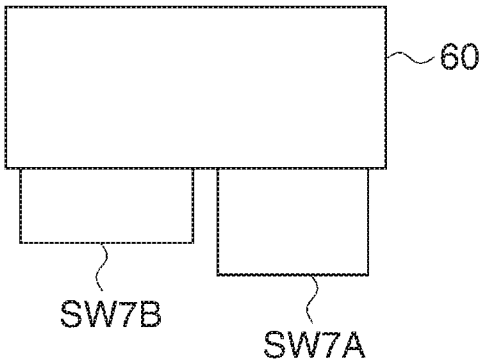
FIG. 8A is a schematic view showing an example in which two detection sections for detecting the turning operation of a hammer are disposed.

FIG. 8A is a schematic view showing an example in which two detection sections SW7A and SW7B for detecting the turning operation of the hammer 11 are disposed. The two detection sections SW7A and SW7B are disposed on the lower face of the silencing stopper 60. The protruding height of the detection section SW7A from the lower face of the silencing stopper 60 is larger than that of the detection section SW7B, whereby the detection section SW7A turns ON earlier than the detection section SW7B.

As representative detection sections SW, the four detection sections SW, that is, the detection sections SW5 and SW6 for detecting the operation of the key K and the detection sections SW7A and SW7B for detecting the operation of the hammer 11 serving as a displacement member, are used as the "object SWs" and the detection section SW5 is used as the detection section SW for silencing.

Figure 8B:
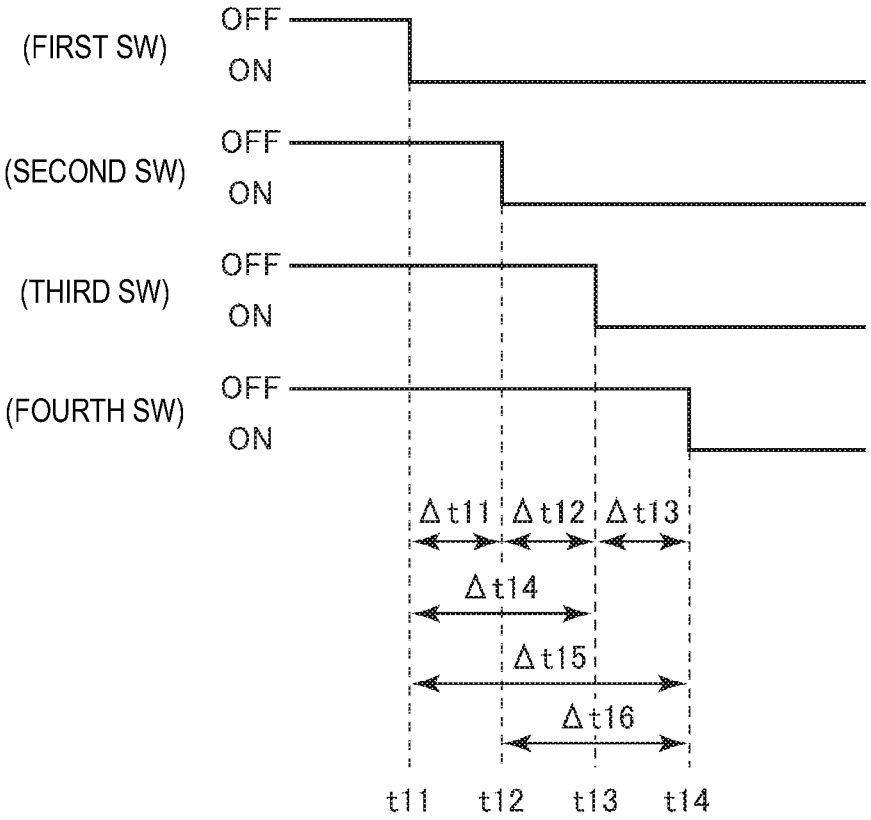
FIG. 8B is a time chart showing the operation detection states of the object detection sections.

FIG. 8B is a time chart showing the operation detection states of the object SWs. In the forward stroke of the key pressing operation, it is assumed that the times at which the states of the first SW, the second SW, the third SW and the fourth SW become detection ON are t11, t12, t13 and t14, respectively. It is also assumed that the time difference between time t11 and time t12 is Δt11, that the time difference between time t12 and time t13 is Δt12, and that the time difference between time t13 and time t14 is Δt13. It is further assumed that that the time difference between time t11 and time t13 is Δt14, that the time difference between time t11 and time t14 is Δt15, and that the time difference between time t12 and time t14 is Δt16.

In the case that the configuration having four object SWs is applied to the first embodiment, the CPU 45 determines the key pressing velocity and generates the musical sound information on the basis of at least any one of the time differences Δt11 to Δt16 at step S302 in FIG. 5. For example, in the selection of the time difference Δt, the smallest value or the median value of the time differences Δt11, Δt12 and Δt13 is selected. Alternatively, the smaller value of the time differences Δt14 and Δt16 is selected. Alternatively, the time difference Δt15 is selected. The key pressing velocity is then obtained by multiplying a coefficient to the reciprocal of the time difference Δt. Furthermore, in addition to the determination of the key pressing velocity, the tone may be determined as necessary on the basis of at least any one of the time differences Δt11 to Δt16. For example, the tone is determined on the basis of the median value or the maximum value of the time differences Δt11 to Δt13. In the case that musical sound is generated on the basis of two or more time differences Δt, the key pressing velocity and the tone may be determined on the basis of the value obtained by proportionally dividing two or more time differences Δt using an appropriate coefficient.

In the case that the configuration having four object SWs is applied to the second embodiment, as in the case in which the configuration is applied to the first embodiment, the CPU 45 determines the key pressing velocity and generates the musical sound information on the basis of at least any one of the time differences Δt11 to Δt16 at step S406 in FIG. 7. Furthermore, since time t14 has not come yet at step S408 in FIG. 7, the CPU 45 determines the key pressing velocity, generates the musical sound information and determines the tone as necessary on the basis of at least any one of the time differences Δt11, Δt12 and Δt14.

In the respective embodiments described above, although application of the keyboard unit according to the present invention to the keyboard musical instrument having the grand piano type action mechanism ACT is taken as an example, the configuration of the keyboard unit according to the present invention is not limited to such a configuration having the action mechanism ACT. In other words, the keyboard unit may merely have a displacement member that is displaced (moved) in the forward stroke direction and the returning direction by key pressing/releasing operation and may not be required to have the action mechanism.

Figure 9:
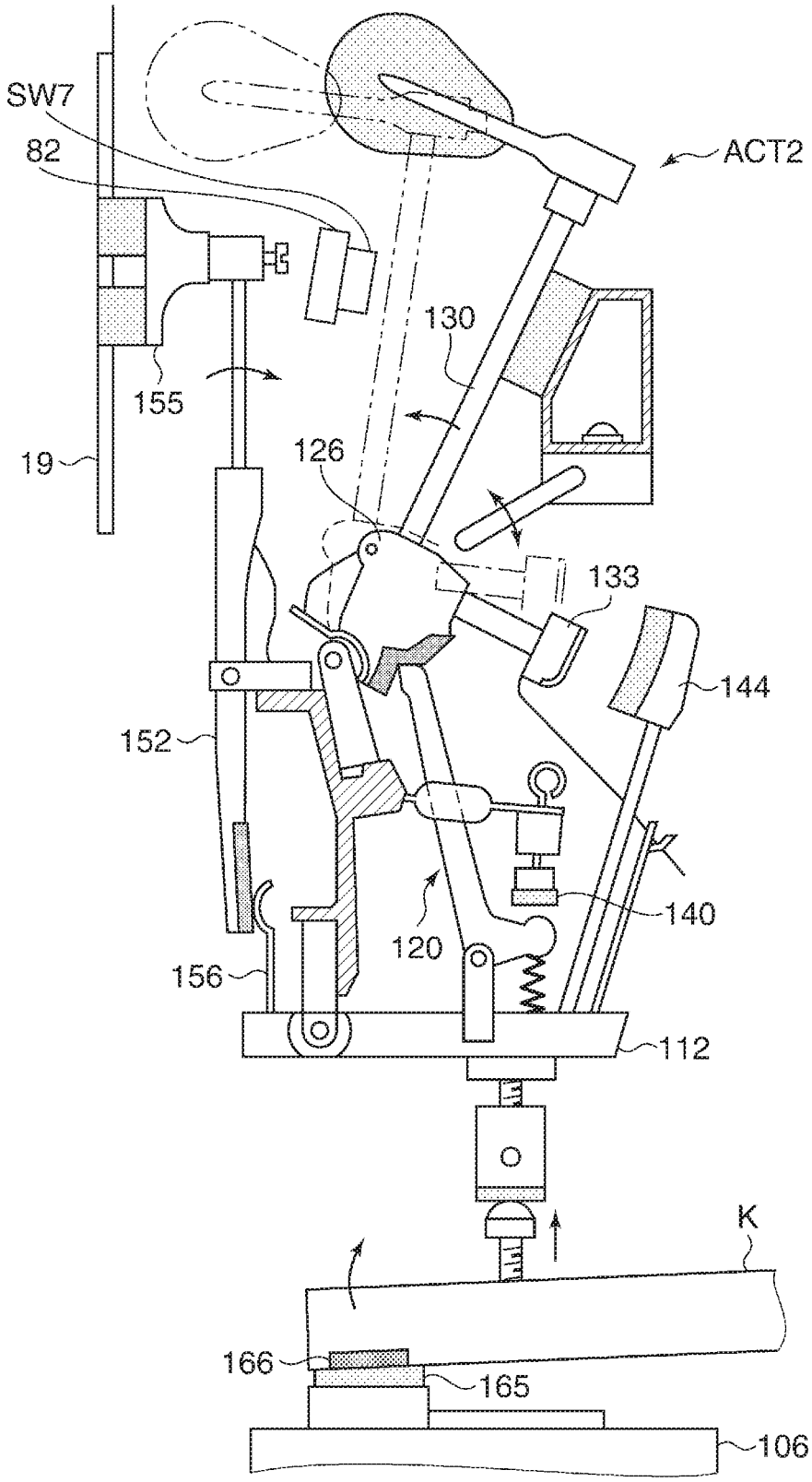
FIG. 9 is a side view showing the action mechanism of an upright piano.

Furthermore, the keyboard unit according to the present invention is also applicable to a keyboard musical instrument having an upright type action mechanism ACT shown in FIG. 9.

FIG. 9 is a side view showing the action mechanism ACT2 of an upright piano. In normal key pressing operation, when the key K is pressed down, a wippen 112 is pushed up and turned, whereby a jack 120 is raised. When the jack 120 is raised, a bat 126 is pushed up by the jack 120, whereby a hammer 130 is turned counterclockwise as shown in FIG. 9. The jack 120 is raised and turned. In the middle of being raised and turned, the jack 120 makes contact with a regulating button 140 and is turned clockwise, thereby escaping temporarily from the lower section of the bat 126. Moreover, when the wippen 112 is raised and turned, a damper spoon 156 turns a damper lever 152 clockwise, whereby a damper 155 is separated from the string 19.

After the damper 155 is separated from the string 19, the hammer 130 strikes the string 19. The hammer 130 is then bounced back, and a catcher 133 is elastically received by a back check 144. The jack 120 is released from the regulating button 140 by the turning and lowering of the wippen 112 accompanied by key releasing operation, whereby the jack 120 is turned and then returned to its original position, and the upper end of the jack 120 again enters the lower section of the bat 126. Hence the next string striking operation can be carried out using the same key K.

A key back rail cloth 165 is disposed so as to be fastened to a shelf board 106, and a conductive section 166 is provided at the rear lower section of the key K. Like the silencing stopper 60, a silencing stopper 82 is configured so that its position can be switched for use in the silencing mode.

In the above-mentioned configuration, for example, the silencing stopper 82 may be provided with the detection section SW7 (or the detection sections SW7A and SW7B). Furthermore, the detection sections SW may also be provided between the bat 126 and the jack 120, between the regulating button 140 and the jack 120, between the lower face (the conductive section 166 thereof) of the key K and the key back rail cloth 165, etc.

According to an aspect of the present invention, while the results of the detection at three or more positions are monitored, musical sound is generated and can be made useful for appropriate musical sound control.

In the invention, the generator may be configured to determine a timing at which the state of the last object detection section in the forward stroke of the key pressing operation becomes the state change detection state, as a sound generation timing. In this case, the sound generation timing can be determined appropriately so as to match the intention of the player.

In the invention, the generator may be configured to determine a key pressing velocity of the key based on a time difference between timings at which the states of two object detection sections included in each set of the detection sections become the state change detection state. Further, in a case that the states of all the object detection sections become the state change detection state, the generator may be configured to determine the key pressing velocity based on a value obtained by proportionally dividing time differences between timings at which the states of the object detection sections included in each of the at least two sets of the detection sections become the state change detection state. Further, in a case that the state of the last object detection section becomes the state change detection state in the forward stroke of the key pressing operation earlier than the predicted timing determined by the first determiner, the second determiner may be configured to determine a key pressing velocity based on time differences between timings at which the states of the object detection sections of at least one or more sets of the detection sections, each set being formed by combining two object detection sections of the other object detection sections, become the state change detection state. Further, in a case that the predicted timing determined by the first determiner is earlier than the timing at which the state of the last object detection section becomes the state change detection state in the forward stroke of the key pressing operation, the second determiner may be configured to determine a key pressing velocity based on time differences between timings at which the states of the object detection sections of at least one or more sets of the detection sections, each set being formed by combining two object detection sections of the detector including the last object detection section, become the state change detection state.

In these cases, the key pressing velocity can be determined appropriately so as to match the intention of the player.

In the invention, the object detection sections of the detector may include a detection section, a state of which becomes the state change detection state when a displacement end position of the displacement member in the forward stroke direction is restricted. In this case, the sound generation timing can be determined more appropriately.

Although the present invention has been described above on the basis of the preferred Embodiments thereof, the present invention is not limited to these specific embodiments, but various embodiments within the scope not departing from the gist of the present invention are also included in the present invention. Some parts of the above-mentioned embodiments may be combined appropriately.

What is claimed is:

1. A keyboard unit comprising:

a key;

at least one displacement member which is configured to be driven directly or indirectly with the key by a pressing operation of the key to be moved in a forward stroke direction;

a detector including, as object detection sections, at least three detection sections including:

a detection section, a state of which becomes a state change detection state when detecting a change in a state of the key; and a detection section, a state of which becomes a state change detection state when detecting a change in a state of the displacement member; and a generator, in a case that states of all the object detection sections become the state change detection state in the forward stroke of a key pressing operation, which is configured to obtain detection results of at least two sets of the detection sections, each set including two object detection sections, which is configured to select at least one of the obtained detection results of the at least two sets of the detection sections, and which is configured to generate sound generation indication information based on the selected at least one of the detection results.

2. The keyboard unit according to claim 1, wherein the generator is configured to determine a timing at which the state of the last object detection section in the forward stroke of the key pressing operation becomes the state change detection state, as a sound generation timing.

3. The keyboard unit according to claim 1, wherein the generator is configured to determine a key pressing velocity of the key based on a time difference between timings at which the states of two object detection sections included in each set of the detection sections become the state change detection state.

4. The keyboard unit according to claim 3, wherein in a case that the states of all the object detection sections become the state change detection state, the generator is configured to determine the key pressing velocity based on a value obtained by proportionally dividing time differences between timings at which the states of the object detection sections included in each of the at least two sets of the detection sections become the state change detection state.

5. The keyboard unit according to claim 1, wherein the object detection sections of the detector include a detection section, a state of which becomes the state change detection state when a displacement end position of the displacement member in the forward stroke direction is restricted.

6. The keyboard unit according to claim 1, wherein musical sound is generated based on the sound generation indication information generated by the generator.

7. The keyboard unit according to claim 1, wherein the sound generation indication information generated by the generator is output to an external device.

8. The keyboard unit according to claim 1, wherein the sound generation indication information generated by the generator is stored in a storage.

9. A keyboard unit comprising:

a key;

at least one displacement member which is configured to be driven directly or indirectly with the key by a pressing operation of the key to be moved in a forward stroke direction;

a detector including, as object detection sections, three or more detection sections including:

a detection section, a state of which becomes a state change detection state when detecting a change in a state of the key; and a detection section, a state of which becomes a state change detection state when detecting a change in a state of the displacement member;

a first determiner, in a case that states of the object detection sections other than one object detection section of all the object detection sections of the detector become the state change detection state in the forward stroke of a key pressing operation, which is configured to determine a predicted timing of sound generation based on detection results of at least one or more sets of the detection sections, each set being formed by combining two object detection sections of the other object detection sections; and a second determiner, in a case that the state of the last object detection section of the detector in the forward stroke of the key pressing operation becomes the state change detection state earlier than the predicted timing determined by the first determiner, which is configured to determine a timing at which the state of the last detection section becomes the state change detection state, as a sound generation timing, and, in a case that the predicted timing is earlier than the timing at which the state of the last object detection section of the detector becomes the state change detection state, which is configured to determine the predicted timing, as a sound generation timing.

10. The keyboard unit according to claim 9, wherein in a case that the state of the last object detection section becomes the state change detection state in the forward stroke of the key pressing operation earlier than the predicted timing determined by the first determiner, the second determiner is configured to determine a key pressing velocity based on time differences between timings at which the states of the object detection sections of at least one or more sets of the detection sections, each set being formed by combining two object detection sections of the other object detection sections, become the state change detection state.

11. The keyboard unit according to claim 9, wherein in a case that the predicted timing determined by the first determiner is earlier than the timing at which the state of the last object detection section becomes the state change detection state in the forward stroke of the key pressing operation, the second determiner is configured to determine a key pressing velocity based on time differences between timings at which the states of the object detection sections of at least one or more sets of the detection sections, each set being formed by combining two object detection sections of the detector including the last object detection section, become the state change detection state.

12. A keyboard musical instrument comprising the keyboard unit according to claim 1.

13. A keyboard unit comprising:

a key;

at least one hammer which is configured to be driven directly or indirectly with the key by a pressing operation of the key to be moved in a forward stroke direction;

object detection sections which are at least three detection sections including:

a detection section, a state of which becomes a state change detection state when detecting a change in a state of the key; and a detection section, a state of which becomes a state change detection state when detecting a change in a state of the hammer; and a control circuit, in a case that states of all the object detection sections become the state change detection state in the forward stroke of a key pressing operation, which is obtain detection results of at least two sets of the detection sections, each set including two object detection sections, which is configured to select at least one of the obtained detection results of the at least two sets of the detection sections, and which is configured to generate sound generation indication information based on the selected at least one of the detection results.

* * * * *